US006151936A

United States Patent [19]

Randall

[11] Patent Number: 6,151,936

[45] Date of Patent: Nov. 28, 2000

[54] METHOD AND APPARATUS FOR LOCK PICK KIT

[76] Inventor: Donald Lee Randall, 153 Redwood Ave., Hamilton Square, N.J. 08610

[21] Appl. No.: 09/390,397

[22] Filed: Sep. 3, 1999

[51] Int. Cl.[7] ..... E05B 19/20

[52] U.S. Cl. ..... 70/394; 70/380; 70/465; 29/426.1; 29/426.4

[58] Field of Search ..... 70/1.5, 1.7, 380, 70/394, 417, 465, 379 R, 379 A, 371; 29/426.1, 426.4, 426.5; 33/539, 540

[56] References Cited

U.S. PATENT DOCUMENTS

| | | | |
|---|---|---|---|
| 4,517,746 | 5/1985 | Easley | 70/394 X |
| 4,586,233 | 5/1986 | Markisello | 70/417 X |
| 4,662,201 | 5/1987 | Phillips | 70/465 |
| 4,667,494 | 5/1987 | Joosten | 70/394 |
| 4,682,398 | 7/1987 | Markisello | 70/417 X |
| 5,325,691 | 7/1994 | Embry | 70/394 |
| 5,402,661 | 4/1995 | Markisello | 70/404 X |
| 5,454,245 | 10/1995 | Markisello | 70/394 X |
| 5,701,773 | 12/1997 | Markisello | 70/394 X |
| 5,956,984 | 9/1999 | Hughes | 70/394 |
| 5,987,946 | 11/1999 | Watts | 70/417 X |

FOREIGN PATENT DOCUMENTS

| | | | |
|---|---|---|---|
| 2388965 | 12/1978 | France | 70/394 |
| 2393904 | 2/1979 | France | 70/394 |
| 320773 | 5/1920 | Germany | 70/394 |
| 51298 | 4/1977 | Japan | 70/394 |

*Primary Examiner*—Lloyd A. Gall
*Attorney, Agent, or Firm*—Kenneth Watov; Watov & Kipnes, P.C.

[57] ABSTRACT

A lock pick kit and method for opening a padlock without the padlock key, through the use of a conventional drill bit and a pair of specialized tools. The lock pick kit comprises a chisel having a shaft with first and second ends, a chisel handle attached to the first end, and a cylindrical protrusion attached to the second end. The second end of the shaft further includes a beveled cutting edge being positioned below and proximate a base portion of the protrusion. The kit further includes a pick having a shaft with first and second ends, a pick handle attached to the first end of the pick, with the pick handle configured to bend at a right angle to the longitudinal axis of the shaft, at its midpoint, an elongated tab extending from the second end of the pick at a right angle to the longitudinal axis of the shaft and a cylindrical protrusion extending from a free end of the elongated tab parallel to the axis of the shaft.

12 Claims, 6 Drawing Sheets

METHOD AND APPARATUS FOR LOCK PICK KIT

FIELD OF THE INVENTION

The field of the present invention relates generally to lock pick sets, and more particularly to lock pick sets for opening padlock locks in the absence of the padlock key. The invention also encompasses a method for opening a padlock without employing the padlock key. The apparatus and method of the present invention are useful, for example, when the key or keys initially provided with the padlock have been lost or misplaced.

BACKGROUND OF THE INVENTION

Loss of padlock keys is a relatively common occurrence and such loss can present considerable difficulties when the padlock is secured in place to lock structures such as storage containers and storage facilities. One can, of course, employ tools such as high speed grinders to grind through the lock to destroy the lock mechanism so that the padlock shackle can be opened or use special cutters to cut through the shackle itself. Grinders and similar types of tools are relatively unsafe and not only can damage property but also cause harm to the individual employing them in an attempt to open a padlock. It is very difficult to cut or drill through a hardened casing to the lock mechanism since the location of such mechanism must be guessed and it is difficult to keep a rotational drill bit properly oriented. Bolt cutters have also been employed. However, certain types of padlock configurations are such that a bolt cutter cannot be properly positioned relative to the shackle of the padlock to sever it. The above-described methods also precludes any opportunity to substantially salvage the opened padlock for subsequent service.

SUMMARY OF THE INVENTION

The present invention relates to apparatus for opening a padlock without the padlock key thereof through use of a conventional drill bit attached to a drill device and two specialized tools. The drill bit is properly positioned to the padlock so that the drill bit engages a retainer assembly of the padlock and initially prepares the surface for the lock pick tools. An intermediate tool is used to further prepare the surface and the final tool deactivates the mechanism so that the padlock shackle can be readily released. Opening of the padlock is accomplished very quickly and safely. The apparatus of the invention is further characterized by its relative simplicity and low cost.

The present invention is generally directed to a lock pick kit for opening a padlock. The padlock includes a outer casing having a hollow interior cavity, a top end, a bottom end and side portions. The padlock further includes a shackle connected through the top end of the outer casing, a cylindrical sleeve containing a tumbler assembly defining a keyway rotatably mounted within the interior cavity of the outer casing, extending wholly into the interior cavity. The keyway is accessible at the bottom end of the housing. The tumbler assembly is operatively associated with a retainer assembly located within the interior cavity. The retainer assembly is positioned between the top end and the tumbler assembly and is further configured to releasably engage with the shackle.

The lock pit kit of the present invention comprises, in combination, a drill bit sized for insertion through a keyway of the padlock for drilling a hole into a surface of a retainer assembly of a padlock, a chisel having a shaft sized for insertion into the keyway, the chisel having one end formed for indexing into the hole, and other end protruding from the keyway, the one end being further formed upon forcefully striking the other end of the chisel, forming a slot from the hole in the surface of the retainer assembly of the padlock, and a pick having a shaft sized for insertion into the keyway, with one end of the shaft being formed for insertion in the slot, and other end of the shaft being formed into a handle protruding from the keyway, for permitting the pick to rotate the retainer assembly to open the locked padlock, by releasing the shackle thereof.

The present invention is further directed to a lock pick kit for opening a padlock, especially a padlock manufactured by the American Lock Company.

The present invention also encompasses a method for opening a padlock.

BRIEF DESCRIPTION OF THE DRAWINGS

Various embodiments of the present invention will be described in detailed below with reference to the accompanying drawings, in which like items are identified by the same reference designation, wherein.

DETAILED DESCRIPTION OF THE INVENTION

The lock pick kit of the present invention provides an improved lock opening apparatus so that the user can more easily open a padlock lock without potential injury to self or damage to property. The lock pick kit is especially useful on AMERICAN LOCK® name brand padlocks which are considered pick-proof. More specifically, these padlocks are rekeyable types with brass retainers, and also utilize a standard keyway with 5 or 6 pin cylinders. However, the present invention is not meant to be limited as such, and is useful for opening padlock locks produced by other manufacturers, where the padlocks are similar to the AMERICAN LOCK® design.

Figure 1:
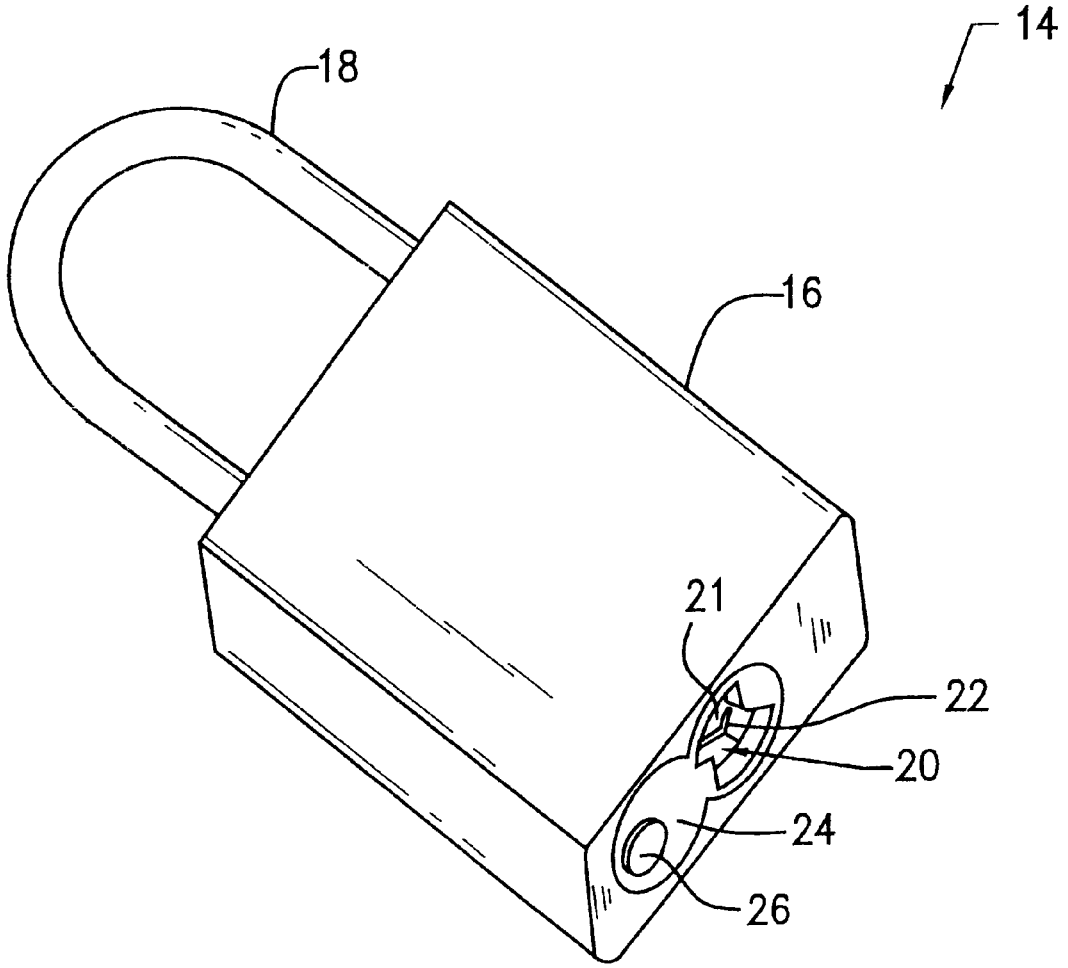
FIG. 1 is a pictorial view of a typical padlock.

Referring now to the drawings, specifically FIG. 1, a typical padlock 14 includes an outer casing 16 and a shackle 18 connected to the outer casing 16. The particular form of padlock illustrated is of conventional construction. A cylinder 20 defining a keyway 22 is rotatably mounted relative to the outer casing 16 and extends into the padlock body interior (not shown). The cylinder 20 further includes a tumbler mechanism (not shown) of conventional construction within the padlock body interior. A coverplate 24 may be included to protect the integrity of the lock assembly within the padlock body interior and make it difficult to destroy the interior lock components to prevent disablement of the padlock 14. A security nut 26 is provided to securely retain the coverplate 24 to the outer casing 16.

The padlock 14 is shown with the shackle 18 thereof in closed or locked condition. When the padlock key is lost, it is extremely difficult to cut the shackle 18 to remove the padlock especially when the shackle 18 is short and/or shrouded by a portion of the outer casing, and such attempts can be dangerous as well as cause harm to the structure to which the padlock is secured. The same holds true when attempting to grind the padlock with a grinder. While retaining the services of a locksmith to the pick the lock is an option, typical prior art lock picking is time consuming and expensive, some padlocks require up to four hours or more to open the lock by such prior art methods. It is usually not feasible or practical to simply drill a padlock in an attempt to destroy the internal lock mechanism since the drill bit is not likely to be properly placed with respect to such mechanism. An individual is also not likely to know precisely where to drill. In addition, it is difficult to keep the drill bit on track during the drilling operation.

The method and apparatus of the present invention precisely allows a drill bit to be placed with respect to the retainer assembly of a padlock so that the opening of the lock as a result of drilling and picking can take place in a matter of minutes.

Figure 2:
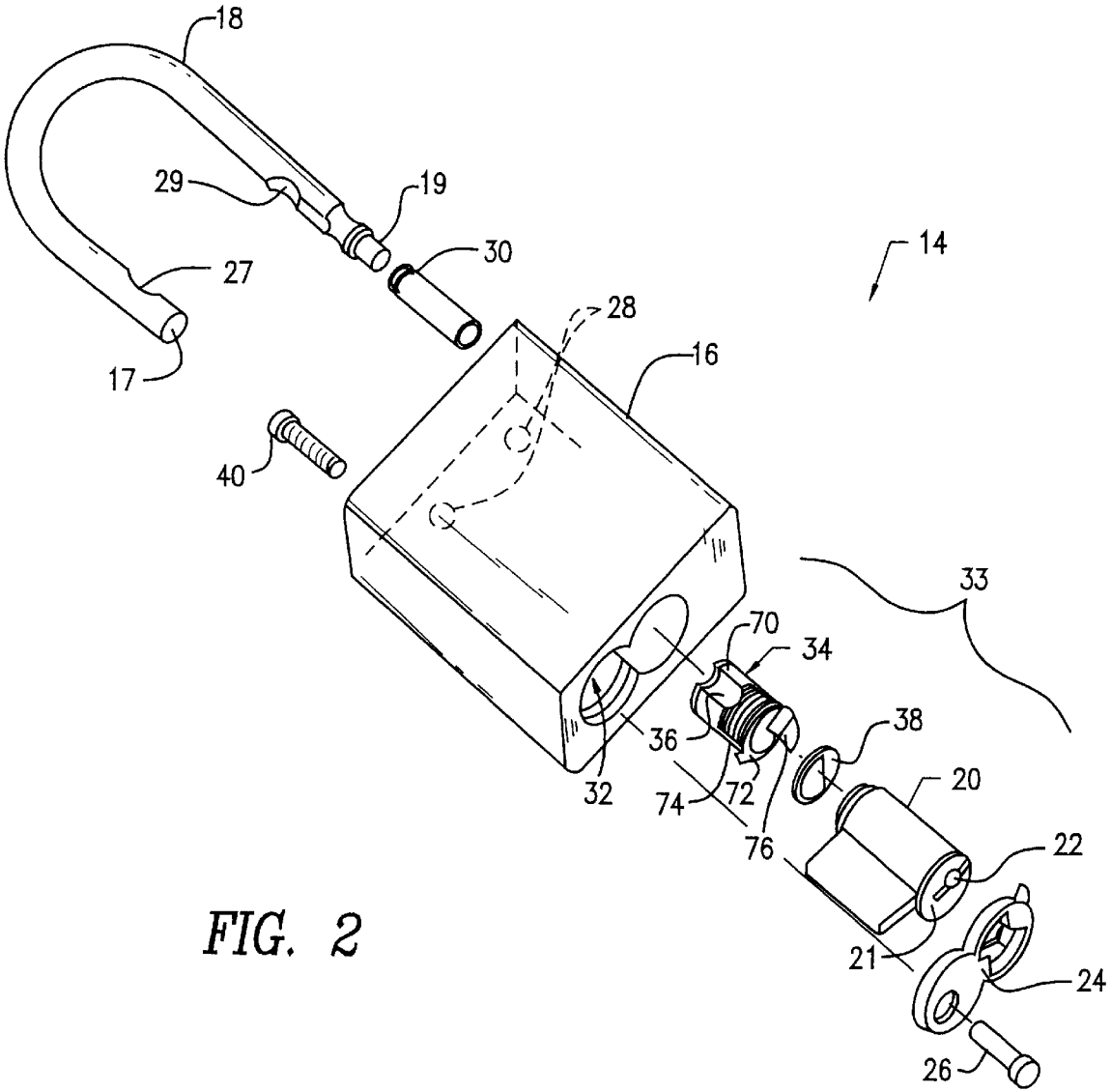
FIG. 2 is an exploded pictorial assembly view of a typical padlock and its component parts.

Referring to FIG. 2, the padlock 14 of FIG. 1 is shown in an exploded pictorial assembly view. The shackle 18 is typically a U-shaped component with a free end 17 and a fastened end 19 which is permanently engaged with one of two ball bearings 28 located in the outer casing 16. In the unlocked state, the shackle 18 is biased up by a shackle spring 30 at the fastened end 19 with the free end 17 permitted to swing freely. The shackle 18 can then be inserted or removed through a staple or link for security/release. In the locked state, the shackle 18 is retracted with the free end 17 inserted into the outer casing 16 through a shackle bore (not shown) for forming a secure closed loop. The end 17 and 19 of the shackle 18 are captively secured by a locking mechanism 33 which forces upon each of the ball bearings 28 against a corresponding notch 27, 29 in the shackle 18 within the outer casing 16.

The locking mechanism 33 includes a retainer assembly 34 which operably engages with a pair of ball bearings 28 in the upper portion of a padlock interior 32 as defined by the outer casing 16. The retainer assembly 34 is a substantially cylindrical component comprising a housing 72, rotatable inner core 70, and a coil spring 74 enveloping the housing 72 for biasing the core 70 into a locking position. With the retainer core 70 in the locked position, the ball bearings 28 are forcibly engaged with the shackle 18 to prevent movement of the shackle 18 out of the outer casing 16. A pair of longitudinal grooves 36, each located on opposite sides of the retainer core 70 are configured to receive the ball bearings 28. When the retainer core 70 is in the unlocked position, the grooves 36 are in position to receive the ball bearings 28 for disengagement with the shackle 18 and thereby permitting the release of the shackle 18 from the outer casing 16.

The cylinder 20 is operatively engaged with the retainer assembly 34 to prevent unauthorized opening of the padlock 14. The cylinder 20 further houses a tumbler mechanism (not shown) that works in combination with a keyway core 21 which defines a keyway 22 to the exterior. The tumbler mechanism (not shown) upon engagement with an appropriate key, permits the keyway core 21 to rotatably slide for turning engagement with the retainer assembly 34 to consequently unlock the padlock 14.

A retainer shield 38 is located between the retainer assembly 34 and cylinder 20. The retainer shield 38 is typically made of hardened steel and serves to discourage any picking of the retainer assembly 34.

The above-described locking mechanism 33 is assembled and maintained within the padlock interior 32. A coverplate 24 typically made of hardened steel secures the locking mechanism 33 and prevents any tampering of the padlock for increased security. The coverplate 24 is securely fastened to the outer casing 16 by a security nut 26 in conjunction with a security screw 40. The security screw 40 is located within the interior of the padlock 14 and screwed in through the shackle bore (not shown) in engagement with the security nut 26.

Figure 3:
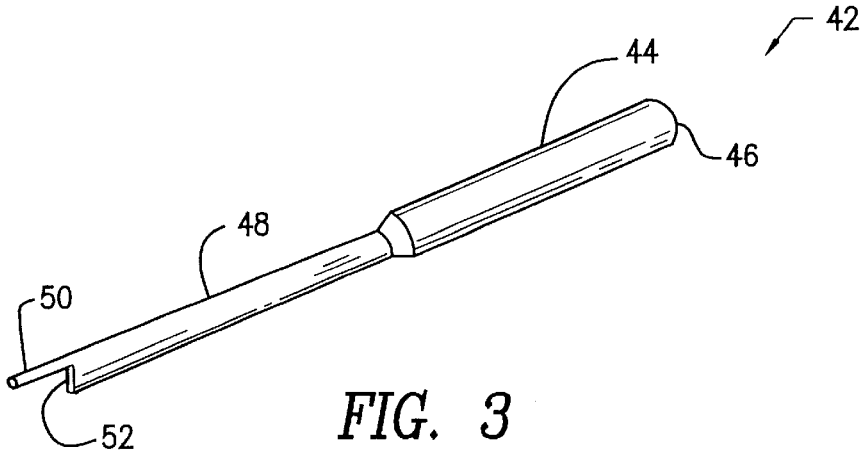
FIG. 3 is a enlarged pictorial view of a retainer chisel showing a blade at a front portion below a guide tip.
Figure 4:
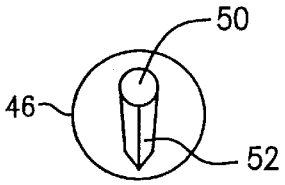
FIG. 4 ont elevational view of the retainer chisel.
Figure 5:
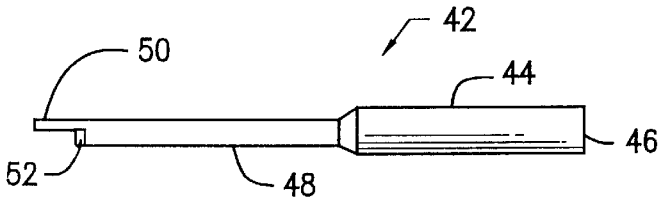
FIG. 5 is a side elevational view of the retainer chisel.
Figure 6:
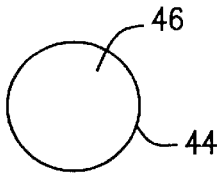
FIG. 6 is a rear elevational view of the retainer chisel.
Figure 7:
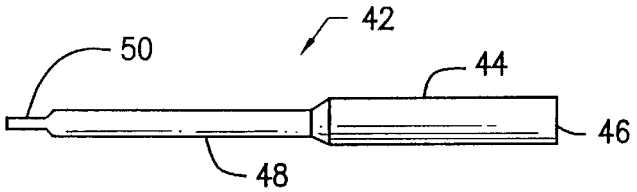
FIG. 7 is a top elevational view of the retainer chisIl.
Figure 8:
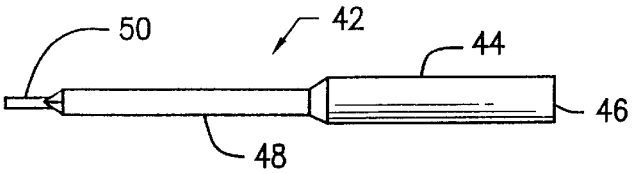
FIG. 8 is a bottom elevational view of the retainer chisel.

Referring to FIG. 3, a preferred embodiment of a retainer chisel 42 is shown. The chisel 42 includes a handle 44 which may optionally have an impact plate 46 placed thereon at one end. At the other end, a chisel shaft 48 extends away and terminates with a cylindrical guide tip 50 making up a portion of the shaft end. The remaining portion of the shaft end includes a sharp blade 52 which does not extend as far as the length of the guide tip 50. Referring to FIGS. 4–8, various views of the retainer chisel 42 are shown for illustrative purposes.

Figure 9:
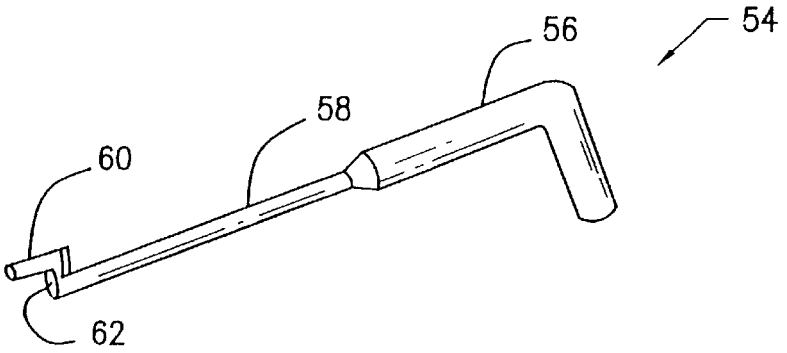
FIG. 9 is an enlarged pictorial view of a retainer pick highlighting a step portion at the front.
Figure 10:
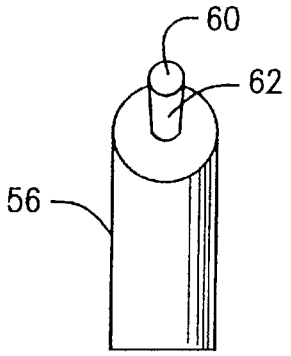
FIG. 10 is a front elevational view of the retainer pick.
Figure 11:
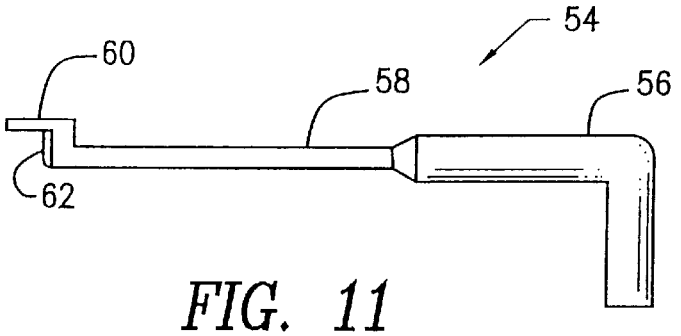
FIG. 11 is a side elevational view of the retainer pick.
Figure 13:
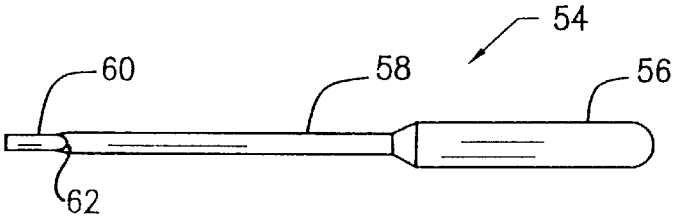
FIG. 13 is a top elevational view of the retainer pick.
Figure 12:
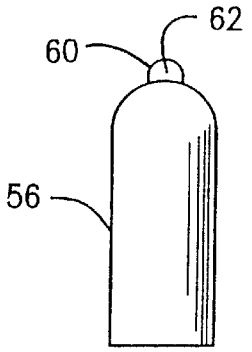
FIG. 12 is a rear elevational view of the retainer pick.
Figure 14:
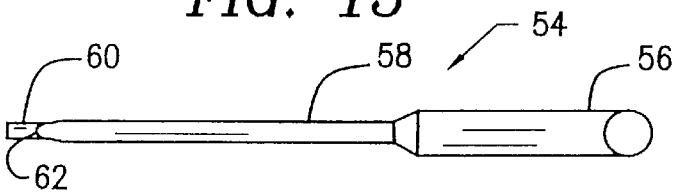
FIG. 14 is a bottom elevational view of the retainer pick.

Referring to FIG. 9, a preferred embodiment of a retainer pick 54 is shown. The retainer pick 54 includes an L-shaped handle 56 for providing increased turning leverage as will be described. A pick shaft 58 extends from the longer end of the handle 56. The pick shaft 58 terminates with a cylindrical guide protrusion 60 that extends parallel to the pick shaft 58 and is offset by a step portion 62. Referring to FIGS. 10–14, various views of the retainer pick 54 are shown for illustrative purposes.

Figure 15:
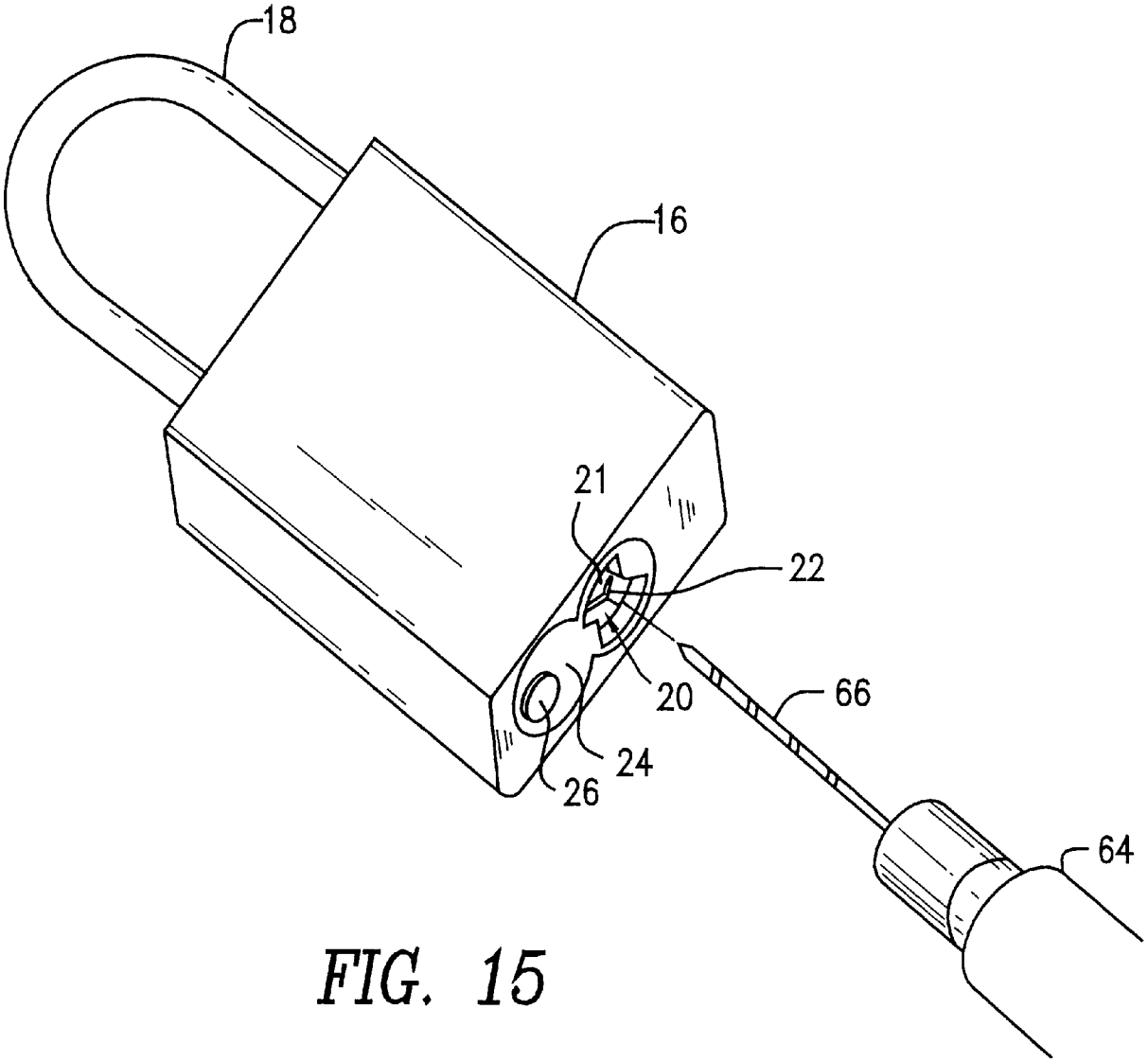
FIG. 15 is a pictorial view of the padlock with a drill and drill bit advancing into the center of the keyway.

With reference to FIG. 15, the initial method step of the present invention will now be discussed in detail. At the initial step of the process, a rotary drill 64 including a drill bit 66 mounted thereon, is used to prepare the retainer assembly for unlocking the padlock 14. Preferably, a sharp #50 or #51 drill bit is utilized, in this example. However, the drill bit size used depends upon the size of the keyway 22 of the padlock 14. The drill bit 66 is inserted though the centernost part of the keyway 22 until the drill bit 66 hits the end of the retainer assembly 34. It is preferable that the padlock remains immobile throughout the unlocking process.

Figure 16:
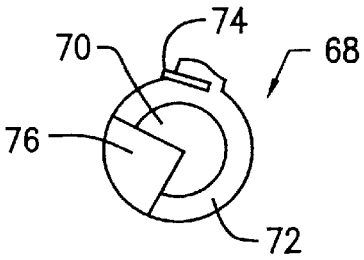
FIG. 16 shows a front elevational view of an intact retainer assembly of the padlock with a lock cylinder and retainer shield removed from the lock bore.
Figure 18:
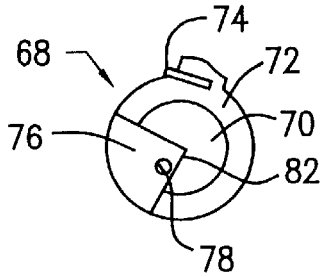
FIG. 18 shows a front elevational view of the retainer assembly of FIG. 16 with a hole bored into a raised portion thereof.
Figure 17:
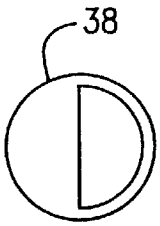
FIG. 17 shows a front elevational view of the retainer shield which is sandwiched between the front portion of the retainer assembly and the rear of the cylinder in the assembled state.

Referring to FIG. 16, an unaltered front portion 68 of the retainer assembly 34 is shown, unobstructed by the retainer shield 38, the cylinder 20 and the coverplate 24. A wedge-like raised portion 76 of the retainer core 70 protrudes from the front portion 68 thereof. The portion 76 is operatively engaged with the keyway core 21 of the cylinder 20 for transmitting a rotary force to rotatably turn the retainer core 70 into the unlocked position. The drill bit 66 fashions a hole 78 in the raised portion 76 preferably adjacent to a lower edge portion 82 thereof as shown in FIG. 18. FIG. 17 illustrales the retainer shield 38 before drilling at a position relative to the retainer assembly 34 of FIG. 16 (also see FIG. 2).

Figure 19:
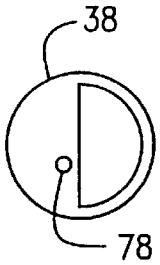
FIG. 19 shows a front elevational view of the retainer shield of FIG. 17 with a hole therein corresponding with the hole in the retainer assembly.

As the end of the drill bit 66 hits the end of the keyway 22, the drill 64 is actuated to fabricate a hole 78 to about a half inch or so in depth, for example, through the retainer shield 38 as shown in FIG. 19 and through the raised portion 76 as shown in FIG. 18.

Figure 22:
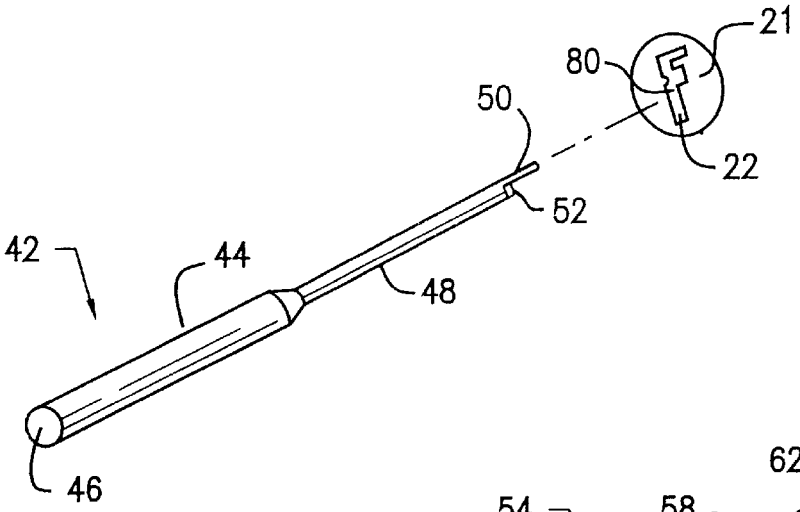
FIG. 22 is a pictorial view of an exterior portion of the cylinder with a guide tip and blade of the retainer chisel entering the center of the keyway with the cutting edge proceeding to the center innermost portion of the slot in the keyway.

Upon completion of drilling, the drill bit 66 is withdrawn from the center of the keyway 22. It is preferable that substantially all of the drill filings be shaken out of the cylinder 20. Next, as shown in FIG. 22, the retainer chisel 42 is inserted through the center of the keyway 22 until the guide tip 50 is introduced into the drilled hole 78. It is preferable to wiggle the retainer chisel 42 or turn it slightly clockwise to ensure proper seating of the retainer chisel 42 in the hole 78.

Figure 20:
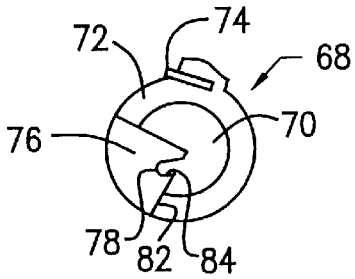
FIG. 20 is a front elevational view of the retai ner assembly with a slot running from the hole in the raised portion and breaking through an edge portion thereof.
Figure 21:
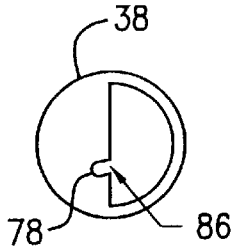
FIG. 21 shows a front elevational view of the retainer shield with a slot running from the hole therein corresponding to the slot in the retainer assembly of FIG. 20.

Once the guide tip 50 is properly seated within the hole 78, a hammer (not shown) is then used to pound the retainer chisel 42 on the impact plate 46. This drives the blade 52 as far as it can go through the raised portion 76 and the edge portion 82 to form a slot 84 as shown in FIG. 20. In FIG. 21, a corresponding slot 86 is also formed by the retainer chisel 42 in the retainer shield 38. Once the slots 84 and 86 are made down to the core 70, the surface of the retainer assembly 34 is prepared for the retainer pick 54.

Figure 23:
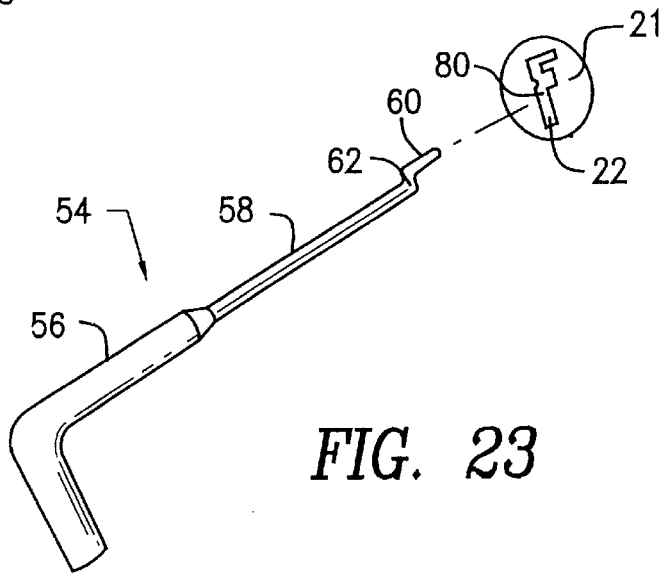
FIG. 23 is a pictorial view of the exterior portion of the cylinder with a guide protrusion and step portion of the retainer pick entering the center of the keyway with the leverage blade oriented toward the centermost slot of the keyway.

As shown in FIG. 23, the retainer pick 54 is inserted all the way through the centermost portion 80 of the keyway 22. The pick 54 must be positioned so that the guide protrusion 60 enters through the centermost portion 80, and that the step portion 62 and the shaft 58 are oriented towards the pins (not shown) in the cylinder 20. The pick 54 must be maneuvered about to insert the guide protrusion 60 into the hole 78 in the core 70, and to properly seat the step portion 62 within the retainer slots 84 and 86. If the pick 54 cannot be properly seated, the hole 78 may not have been drilled deep enough into the core 70. The drilling and chisel steps as described above must be repeated to a deeper depth. Once the retainer pick 54 is seated properly within the retainer assembly 34, the pick 54 is rotated clockwise about its axis to forcibly rotate the retainer core 70 into the unlocked position. The pick 54 will encounter some resistance due to the coil spring 74 so it would be useful to utilize the L-shaped handle 56 for better turning leverage.

Utilizing this method and apparatus as described, the present invention provides the individual with the option of reusing the opened padlock 14 which would not be possible with more destructive lock opening methods of the prior art. To save the undamaged components of the padlock 14, keep the retainer pick 54 within the keyway 22. Move the free end 17 of the unlocked shackle 18 away from the shackle bore (not shown). Unscrew the security screw 40 within the shackle bore (not shown) and then remove the security nut 26 from the coverplate 24. Next, remove the coverplate 24 to free the cylinder 20. Once the cylinder 20 is removed, the retainer pick 54 may then be withdrawn. Thereafter, a new key can be made for the cylinder 20, and the cylinder 20 and coverplate 24 are then re-installed, whereby the padlock is ready for use.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A lock pick kit for opening a locked padlock, comprising:

a drill bit sized for insertion through a keyway of said padlock for drilling a hole into a surface of a retainer assembly of said padlock;

a chisel having a shaft sized for insertion into said keyway, said chisel having one end formed for indexing into said hole, and another end protruding from said keyway, said one end being shaped for upon forcefully striking said another end of said chisel, forming said hole in said surface of said retainer assembly into a slot; and a pick having a shaft sized for insertion into said keyway, with one end of said shaft being formed for insertion in said slot, and other end of said shaft being formed into a handle protruding from said keyway, for permitting said pick to rotate said retainer assembly to open said locked padlock, by releasing a shackle thereof.

2. A lock pick kit for opening a padlock, said padlock including an outer casing having a hollow interior cavity, a top end, a bottom end, and side portions, said padlock further including a shackle connected through said top end of said outer casing, a cylindrical sleeve containing a tumbler assembly defining a keyway rotatably mounted within said interior cavity of said outer casing, extending wholly into said interior cavity, with said keyway accessible at said bottom end of said outer casing, and said tumbler assembly being operatively associated with a retainer assembly within said irterior cavity, said retainer assembly being configured to releasably engage with said shackle, said lock pick kit comprising:

a) a chisel including:

a shaft having first and second ends;

a chisel handle attached to said first end; and a cylindrical protrusion attached to said second end;

said second end further including a beveled cutting edge being positioned below and proximate a base portion of said protrusion;

b) a pick including:

a shaft having first and second ends;

a pick handle attached to said first end of said pick, said pick handle being configured at a right angle to the longitudinal axis of said shaft;

an elongated tab extending from said second end of said pick at a right angle to the longitudinal axis of said shaft;

a cylindrical protrusion extending from a free end of said elongated tab, parallel to said axis of said shaft; and c) a drill bit for attachment to a rotational drill.

3. A lock pick kit for opening a padlock, said padlock including an outer casing having a hollow interior cavity, a top end, a bottom end, and side portions, said padlock further including a shackle connected through said top end of said outer casing, a cylindrical sleeve containing a tumbler assembly defining a keyway rotatably mounted within said interior cavity of said outer casing, extending wholly into said interior cavity, with said keyway accessible at said bottom end of said outer casing, and said tumbler assembly being operatively associated with a retainer assembly within said interior cavity, said retainer assembly being configured to releasably engage with said shackle, said lock pick kit comprising:

a) a drill bit for attachment to a rotary drill device;

b) a chisel with a handle and a shaft sized to work in said padlock keyway;

c) said chisel having a guide tip opposite the handle end, and a blade adjacent to said tip, with an edge portion projecting away from said shaft;

d) a pick including a shaft with a handle formed at one end, said shaft being sized to fit in said padlock keyway, said pick having a rod-like guide protrusion formed on an opposite end of said shaft, said protrusion being parallel to said pick shaft and offset by a step from said shaft; and e) said chisel being adapted via striking an end of said handle to form a gripping slot into a surface of said retainer assembly, to allow said pick to engage with said slot, whereafter rotation of said pick protrusion and step forces the retainer assembly to an unlocked position, thereby releasing said shackle thereof.

4. The kit of claim 3, wherein said chisel is configured to cut a slot through a retainer shield located between a cylinder and a rctainer assembly in said padlock.

5. The kit of claim 3, wherein said pick handle is L-shaped.

6. The kit of claim 3, wherein said chisel and said pick each are comprised of a rigid material.

7. The kit of claim 6 wherein said rigid material is a hardened steel.

8. A method for opening a padlock including an outer casing having a hollow interior cavity, a top end, a bottom end, and side portions, said padlock further including a shackle connected through said top end of said outer casing, a cylindrical sleeve containing a tumbler assembly defining a keyway rotatably mounted within said interior cavity of said outer casing, extending wholly into said interior cavity, with said keyway accessible at said bottom end of said outer casing, and said tumbler assembly being operatively associated with a retainer assembly within said interior cavity, said retainer assembly being configured to releasably engage with said shackle, the method comprising the steps of:

securing a drill bit to a drill device;

inserting the free end of said drill bit into the center of said padlock keyway until the tip strikes the end of said keyway;

drilling a hole to a depth of about half an inch;

removing said drill bit from said keyway;

placing a chisel proximate the center of said keyway;

positioning said chisel to insert a guide tip thereof into said hole;

slightly turning said chisel clockwise to ensure proper seating of said chisel in said keyway;

striking an end of said chisel protruding from said keyway to form a slot in a surface of said retainer assembly;

removing said chisel after forming said slot;

inserting a pick in the center of the keyway;

positioning said pick until a guide protrusion and step thereof is seated in said slot; and slowly rotating said pick clockwise to rotatably force said retainer assembly into an unlocked position.

9. The method of claim 8, after unlocking said padlock, further including the steps of:

moving one end of the shackle away from a shackle hole;

unscrewing a security screw exposed in said shackle hole, said screw retaining said cylindrical sleeve with said tumbler assembly by being mated to a security nut inserted through a coverplate over said keyway at the bottom end of said outer casing;

removing said coverplate and security nut from said outer casing; and removing said cylindrical sleeve with said tumbler assembly from said interior cavity of said padlock; and removing said pick from said keyway.

10. The method of claim 9, after the drilling the hole further including the steps of:

orienting said bottom end of said outer casing in a downward position; and shaking said padlock for emptying drill filings from said keyway.

11. The method of claim 9, for reusing said padlock, further including the steps of:

using said cylindrical sleeve with said tumbler assembly to make a new key;

reinstalling said cylindrical sleeve with said tumbler assembly;

reinstalling said coverplate and security nut to said outer casing; and rescrewing said security screw in said shackle hole to said security nut.

12. The method of claim 10, for reusing said padlock, further including the steps of:

using said cylindrical sleeve with said tumbler assembly to make a new key;

reinstalling said cylindrical sleeve with said tuLmbler assembly;

reinstalling said coverplate and security nut to said outer casing; and rescrewing said security screw in said shackle hole to said security nut.

* * * * *